US008049697B2

(12) United States Patent
Koo et al.

(10) Patent No.: US 8,049,697 B2
(45) **Date of Patent: *Nov. 1, 2011**

(54) LIQUID CRYSTAL DISPLAY AND DRIVING METHOD THEREOF

(75) Inventors: Sungjo Koo, Daegu (KR); Suhyuk Jang, Daegu (KR); Jongwoo Kim, Kyungbuk (KR)

(73) Assignee: LG Display Co., Ltd., Seoul (KR)

( * ) Notice: Subject to any disclaimer, the term of this patent is extended or adjusted under 35 U.S.C. 154(b) by 688 days.

This patent is subject to a terminal disclaimer.

(21) Appl. No.: 12/003,747

(22) Filed: Dec. 31, 2007

(65) Prior Publication Data

US 2009/0002291 A1 Jan. 1, 2009

(30) Foreign Application Priority Data

Jun. 28, 2007 (KR) ..... 10-2007-0064561

(51) Int. Cl.
*G09G 3/36* (2006.01)

(52) U.S. Cl. ..... 345/89; 345/96; 345/209

(58) Field of Classification Search ..... 345/87–100, 345/204, 208–210; 349/123, 124, 126, 128, 349/133, 167, 171, 172
See application file for complete search history.

(56) References Cited

U.S. PATENT DOCUMENTS 6,756,957 B2 6/2004 Park
7,030,843 B2 4/2006 Youn
7,570,243 B2 * 8/2009 Kang et al. ..... 345/98
7,643,002 B2 * 1/2010 Kang et al. ..... 345/100
7,683,870 B2 * 3/2010 Kang et al. ..... 345/89
2004/0017344 A1 * 1/2004 Takemoto ..... 345/87
2006/0290637 A1 * 12/2006 Kang et al. ..... 345/98
2006/0290638 A1 * 12/2006 Kang et al. ..... 345/98
2006/0291298 A1 * 12/2006 Kang et al. ..... 365/189.07
2009/0002301 A1 * 1/2009 Koo et al. ..... 345/89
2009/0002302 A1 * 1/2009 Koo et al. ..... 345/89

FOREIGN PATENT DOCUMENTS

JP 7-44139 2/1995
JP 2002-196731 7/2002
JP 2003-255917 9/2003
JP 2006-154772 6/2006

* cited by examiner

*Primary Examiner* — Amare Mengistu
*Assistant Examiner* — Dmitriy Bolotin
(74) *Attorney, Agent, or Firm* — Morgan, Lewis & Bockius LLP

(57) ABSTRACT

A liquid crystal display includes a liquid crystal display panel including a plurality of data lines, a plurality of gate lines crossing the plurality of data lines, and a plurality of liquid crystal cells, a timing controller to determine gray levels of input digital video data and a time when a polarity of a data voltage to be supplied to the data lines is inverted, and to generate a dynamic charge share control signal when the gray level of the data voltage is changed from a white gray level to a black gray level and the polarity of the data voltage is inverted, a data driving circuit to convert the digital video data from the timing controller into the data voltage, changing the polarity of the data voltage, and supplying any one of a common voltage and a charge share voltage to the data lines in response to the dynamic charge share control signal, and a gate driving circuit to sequentially supply scan pulses to the gate lines under the control of the timing controller.

6 Claims, 9 Drawing Sheets

Fig. 4

| | | | | | | | | | | |
|---|---|---|---|---|---|---|---|---|---|---|
| L1 | W | W | W | W | G | ... | G | W | W | W | W |
| L2 | B | B | B | B | W | ... | B | B | G | G | B |
| L3 | G | G | G | B | B | ... | W | W | W | W | G |
| L4 | B | B | B | B | B | ... | B | B | G | B | B |
| L5 | G | G | G | G | B | ... | G | G | G | G | W |

W B W B G

LIQUID CRYSTAL DISPLAY AND DRIVING METHOD THEREOF

This application claims the benefit of the Korean Patent Application No. 2007-0064561 filed on Jun. 28, 2007, which is hereby incorporated by reference.

BACKGROUND OF THE INVENTION

1. Field of the Invention

The present invention relates to liquid crystal display, and more particularly to a liquid crystal display and a driving method thereof adapted to reduce heat generation and power consumption of a data driving circuit.

2. Discussion of the Related Art

A liquid crystal display displays images by controlling the light transmittance of liquid crystal cells in response to a video signal. A liquid crystal display of an active matrix type actively controls data by switching a data voltage applied to the liquid crystal cells using a thin film transistor (TFT) formed at every liquid crystal cell Clc, as illustrated in FIG. 1, thereby improving the picture quality of a motion image. As shown in FIG. 1, reference label "Cst" denotes a storage capacitor for sustaining the data voltage charged to the liquid crystal cell "Clc," "D1" denotes a data line through which the data voltage is supplied, and "G1" denotes a gate line through which a scan voltage is supplied.

The liquid crystal display is driven according to an inversion method in which a polarity is inverted between neighboring liquid crystal cells. The polarity is inverted whenever a frame period is shifted in order to reduce a direct current (DC) offset component and the degradation of liquid crystals. However, the swing width of the data voltage, which is supplied to the data lines whenever the polarity of the data voltage is shifted, is increased, thereby generating a great amount of current in a data driving circuit. Thus, problems of rising temperature due to increase in heat generation and power consumption of the data driving circuit increases sharply.

In order to reduce the swing width of the data voltage supplied to the data lines, thereby reducing the heat generated temperature and power consumption of the data driving circuit, a charge sharing circuit or a precharge circuit is adopted in the data driving circuit. However, the effects of these circuits do not provide a satisfactory result.

SUMMARY OF THE INVENTION

Accordingly, the present invention is directed to the liquid crystal display and driving method thereof that substantially obviates one or more problems due to limitations and disadvantages of the related art.

An object of the present invention is to provide a liquid crystal display and a driving method thereof that is adapted to reduce heat generation and power consumption of a data driving circuit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display includes a liquid crystal display panel including a plurality of data lines, a plurality of gate lines crossing the plurality of data lines, and a plurality of liquid crystal cells, a timing controller to determine gray levels of input digital video data and a time when a polarity of a data voltage to be supplied to the data lines is inverted, and to generate a dynamic charge share control signal when the gray level of the data voltage is changed from a white gray level to a black gray level and the polarity of the data voltage is inverted, a data driving circuit to convert the digital video data from the timing controller into the data voltage, changing the polarity of the data voltage, and supplying any one of a common voltage and a charge share voltage to the data lines in response to the dynamic charge share control signal, and a gate driving circuit to sequentially supply scan pulses to the gate lines under the control of the timing controller.

In another aspect, a method of driving a liquid crystal display including a liquid crystal display panel having a plurality of data lines, a plurality of gate lines crossing the plurality of data lines, a plurality of liquid crystal cells, a data driving circuit to convert digital video data into a data voltage to be supplied to the data lines and changing a polarity of the data voltage, and a gate driving circuit to sequentially supply scan pulses to the gate lines, the method includes the steps of determining gray levels of input digital video data and a time when the polarity of the data voltage to be supplied to the data lines is inverted, generating a dynamic charge share control signal when the gray level of the data voltage to be supplied to the data lines is changed from a white gray level to a black gray level and the polarity of the data voltage is inverted, and supplying any one of a common voltage and a charge share voltage to the data lines by controlling the data driving circuit using the dynamic charge share control signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIGS. 4 and 5 are views illustrating exemplary data checks of a data check unit 31 illustrated in FIG. 3;

DETAILED DESCRIPTION OF THE EMBODIMENTS

Reference will now be made in detail to the embodiments of the present invention, examples of which are illustrated in the accompanying drawings.

Figure 1:
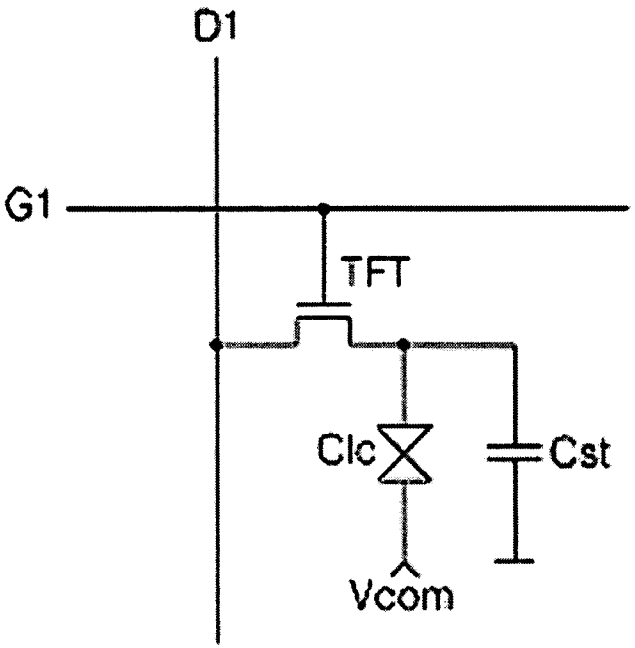
Fig. 1 [RELATED ART]
FIG. 1 is an equivalent circuit diagram of a liquid crystal cell of a liquid crystal display.
Figure 2:
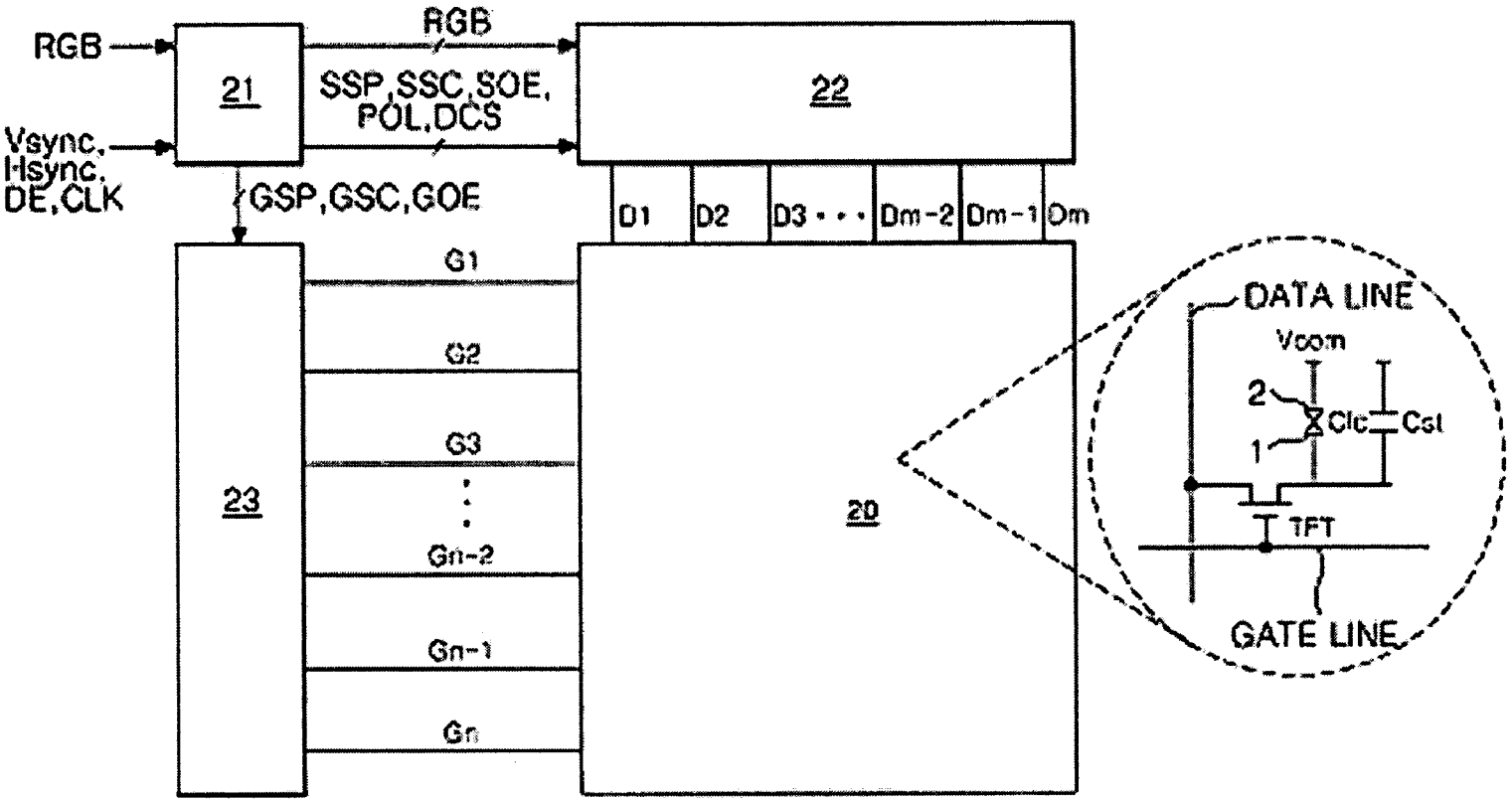
FIG. 2 is a block diagram of a liquid crystal display according to an exemplary embodiment of the present invention.

As shown in FIG. 2, a liquid crystal display according to an exemplary embodiment of the present invention includes a liquid crystal display panel 20, a timing controller 21, a data driving circuit 22, and a gate driving circuit 23. The liquid crystal display panel 20 has liquid crystal molecules injected between two sheets of glass substrates. M data lines D1 to Dm and n gate lines G1 to Gn are formed on a first glass substrate of the liquid crystal display panel 20 so that they cross each other. The liquid crystal display panel 20 includes (m×n) liquid crystal cells Clc arranged in matrix form by the intersecting structure of the data lines D1 to Dm and the n gate lines G1 to Gn.

The data lines D1 to Dm, the gate lines G1 to Gn, thin film transistors ("TFTs"), pixel electrodes 1 of the liquid crystal cell Clc connected to the TFT, a storage capacitor Cst, and other components are formed on the first glass substrate of the liquid crystal display panel 20. A black matrix, a color filter, and a common electrode 2 are formed on a second glass substrate of the liquid crystal display panel 20. The common electrode 2 is formed on the second glass substrate in a vertical electric field mode, such as twisted nematic (TN) and vertical alignment (VA). Alternatively, the common electrode 2 is formed on the first glass substrate together with the pixel electrode 1 in a lateral electric field mode, such as in-plane switching (IPS) and fringe field switching (FFS). Polarization plates having optical axes that are orthogonal to each other are attached to the first and second glass substrates of the liquid crystal display panel 20, respectively. An orientation film for setting a pre-tilt angle of liquid crystal is formed on an inner surface in contact with the liquid crystal.

The timing controller 21 receives timing signals, such as vertical/horizontal sync signals Vsync, Hsync, a data enable signal DE, and a clock signal CLK, and generates control signals for controlling the operational timing of the data driving circuit 22 and the gate driving circuit 23. The control signals include a gate start pulse GSP, a gate shift clock GSC, a gate output enable signal GOE, a source start pulse SSP, a source sampling clock SSC, a source output enable signal SOE, and a polarity control signal POL. The gate start pulse GSP controls a start horizontal line where scanning begins in a 1 vertical period when one screen is displayed. The gate shift clock GSC is a timing control signal input to a shift register of the gate driving circuit 23 to sequentially shift the gate start pulse GSP and is generated with a pulse width corresponding to the on-period of a TFT. The gate output enable signal GOE controls the output of the gate driving circuit 23. The source start pulse SSP controls a start pixel in a one horizontal line in which data is to be displayed. The source sampling clock SSC controls the latch operation of data within the data driving circuit 22 on the basis of the rising or falling edge. The source output enable signal SOE controls to the output of the data driving circuit 22. The polarity control signal POL controls the polarity of a data voltage to be supplied to the liquid crystal cells Clc of the liquid crystal display panel 20. The polarity control signal POL is inverted every N horizontal period, so that the polarity of the data voltage to be supplied to the data lines D1 to Dm of the liquid crystal panel 20 may be inverted according to a vertical N-dot inversion method (where N is an integer equal to or greater than 2).

The timing controller 21 determines when a gray level value of data is changed from a white gray level to a black gray level during two horizontal periods by determining the gray level of the data and determines when the polarity of a data voltage is to be inverted. The timing controller 21 generates a dynamic charge sharing signal (hereinafter, referred to as "DCS") in order to decrease the generation of heat and power consumption of the data driving circuit 22 based on the check result of the data and polarity.

The data driving circuit 22 latches digital video data RGBodd, RGBeven under the control of the timing controller 21, converts the digital video data into analog positive/negative gamma compensation voltages, generates positive/negative data voltages, and supplies the generated data voltages to the data lines D1 to Dm. Further, the data driving circuit 22 supplies a common voltage Vcom or a charge share voltage to the data lines D1 to Dm by performing charge sharing only when the gray level of data is changed from a white gray level to a black gray level and when the polarity of a data voltage supplied to the liquid crystal display panel 20 is inverted in response to the source output enable signals SOE and DCS. The common voltage Vcom is an intermediate voltage between a data voltage of a positive polarity and a data voltage of a negative polarity. The charge share voltage is an average voltage generated when a data line to which the data voltage of a positive polarity is supplied and a data line to which the data voltage of a negative polarity is supplied are shorted.

In known charge share driving methods, charge sharing is performed between data unconditionally. In this case, since the entire data voltages supplied to the data lines D1 to Dm rise from the common voltage Vcom or a charge sharing voltage, the swing widths of the data voltages supplied to the data lines D1 to Dm are increased and the number of the rising edges of the data voltages is increased. Thus, the generation of heat and power consumption of the data driving circuit 22 is likewise increased. By contrast, in accordance with the present invention, charge sharing is performed only when the gray level of data is changed from the white gray level to the black gray level and the polarity of the data voltages supplied to the liquid crystal display panel 20 is inverted. Accordingly, the swing widths of the data voltages supplied to the data lines D1 to Dm and the number of the rising edges of the data voltages may be reduced.

The gate driving circuit 23 includes a plurality of gate drive integrated circuits each of which includes a shift register, a level shifter for converting the output signal of the shift register to a signal having a swing width suitable for TFT driving of a liquid crystal cell, and an output buffer connected between the level shifter and the gate lines G1 to Gn. The gate driving circuit 23 is configured to sequentially output scan pulses having a pulse width of approximately one horizontal period.

Figure 3:
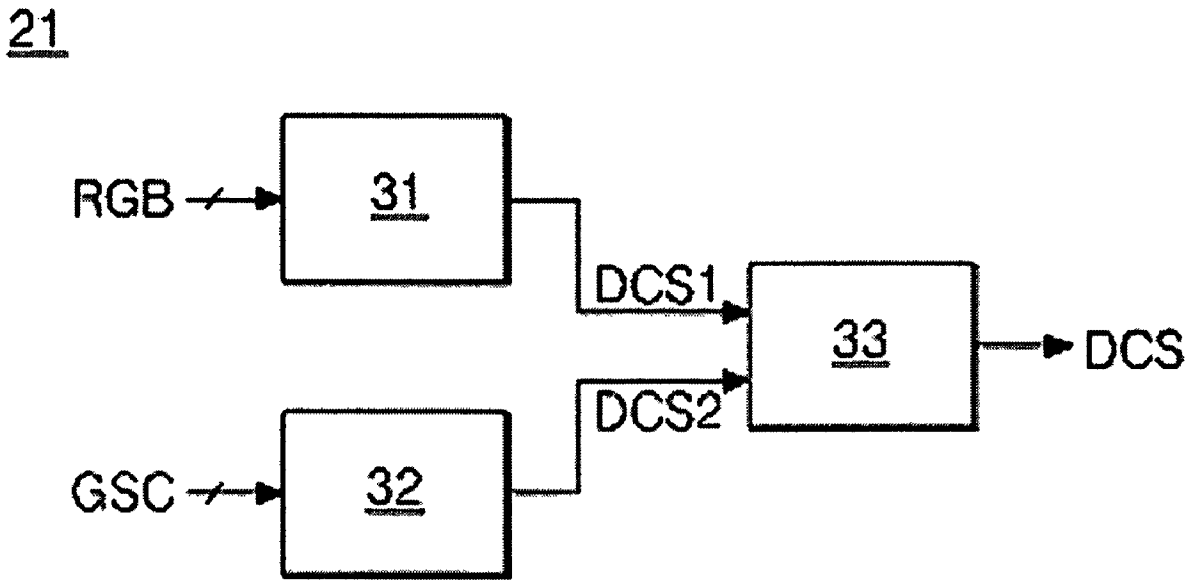
FIG. 3 is a block diagram of an exemplary dynamic charge share (DCS) generating circuit and an exemplary dot inversion control signal generating circuit of a time controller in accordance with the present invention.

FIG. 3 is a block diagram of an exemplary DCS generating circuit, which may be embedded in the timing controller 21, for example. As shown in FIG. 3, the timing controller 21 includes a data check unit 31, a polarity check unit 32, and a DCS generator 33.

The data check unit 31 determines whether two consecutively input data are changed from a white gray level to a black gray level by determining a gray level value of the digital video data RGB. The analyzed gray level is a gray level with respect to each data or a representative gray level of one line. According to the data analysis, the data check unit 31 generates a first DCS signal DCS1, indicating a time when the digital video data RGB is changed from the white gray level to the black gray level.

The polarity check unit 32 determines a time when the polarity of a data voltage to be supplied to the liquid crystal display panel 20 is inverted by counting the gate shift clock GSC and generates a second DCS signal DCS2 indicating the polarity inversion time point. For example, if the data voltage is supplied to the liquid crystal display panel 20 according to the vertical 2-dot inversion method, the polarity check unit 32 counts the gate shift clock GSC, divides the count value into two, and determines a time when the remainder becomes 0 to be the time at which the polarity of data is inverted.

The DCS generator 33 performs an AND operation, for example, on the first DCS signal DCS1 and the second DCS signal DCS2 and generates a final DCS signal. The DCS signal generated from the DCS generator 33 enables charge sharing function of the data driving circuit 22 only when data is changed from the white gray level to the black gray level and the polarity of a data voltage supplied to the liquid crystal display panel 20 is inverted. However, the DCS signal blocks charge sharing to occur in all other situations.

Figure 5:
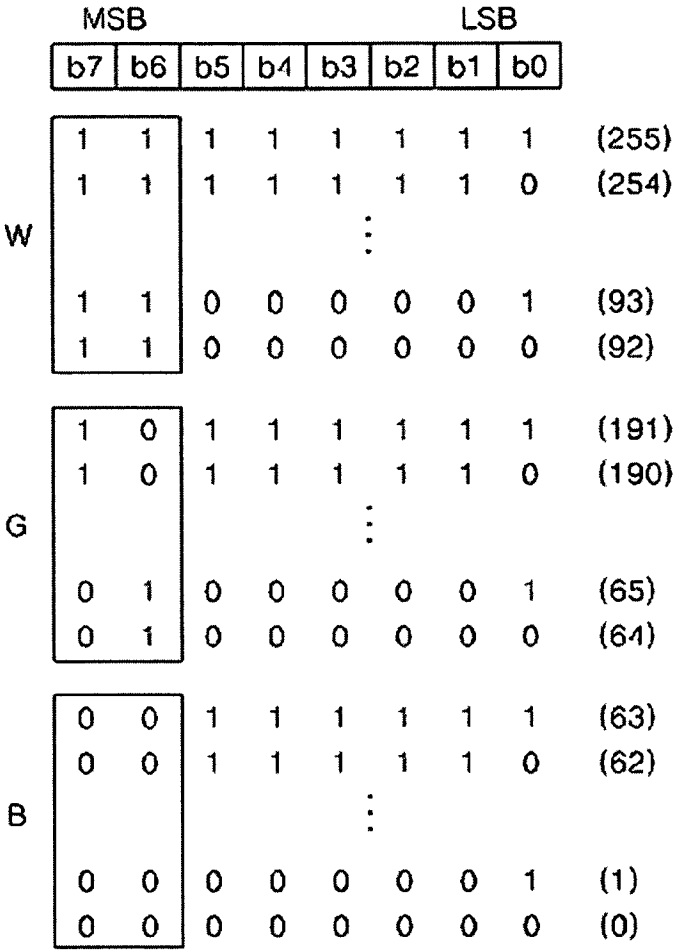

FIG. 4 is an example showing the gray levels of data supplied to liquid crystal cells disposed in five lines, and FIG. 5 illustrates exemplary gray levels of the digital video data. The data check unit 31 determines the gray level of each data included in one line and determines a representative gray level. For example, when a line of display data includes data of 1366 and 50% or more of the data (i.e., 683) is white gray level W, the data check unit 31 designates the representative gray level of the line as being white gray level W, as shown in FIG. 4 (e.g., lines L1 and L3). Further, when 50% or more of a line data is gray gray level G, the data check unit 31 designates the representative gray level of the line as being gray level G, as illustrated in FIG. 4 (e.g., line L5). Further, when 50% or more of the data is black gray level B, the data check unit 31 designates the representative gray level of the line as black gray level B, as shown in FIG. 4 (e.g., lines L2 and L4). It is to be understood that the criterion of the representative gray level, which is 50% in the present example, may be changed according to the driving characteristic of the liquid crystal panel without departing from the scope of the present invention.

In the present example, the gray level of data is determined using only the most significant 2 bits ("MSB") of the digital video data, as shown in FIG. 5. When the data is an 8-bit data, the MSB of upper gray levels (i.e., 192 to 255 gray levels) are "11." The MSB of intermediate gray levels (i.e., 64 to 191 gray levels) are "10" or "01." The MSB of lower gray levels (i.e., 0 to 63 gray levels) are "00." Thus, when the most significant 2 bits of the digital video data RGB are "11," the data check unit 31 determines the gray level of the data as being white gray level W. When the most significant 2 bits of the digital video data RGB are "10" or "01," the data check unit 31 determines the gray level of the data as being gray gray level G. Further, when the most significant 2 bits of the digital video data RGB are "00," the data check unit 31 determines the gray level of the data as being black gray level B.

Figure 6A:
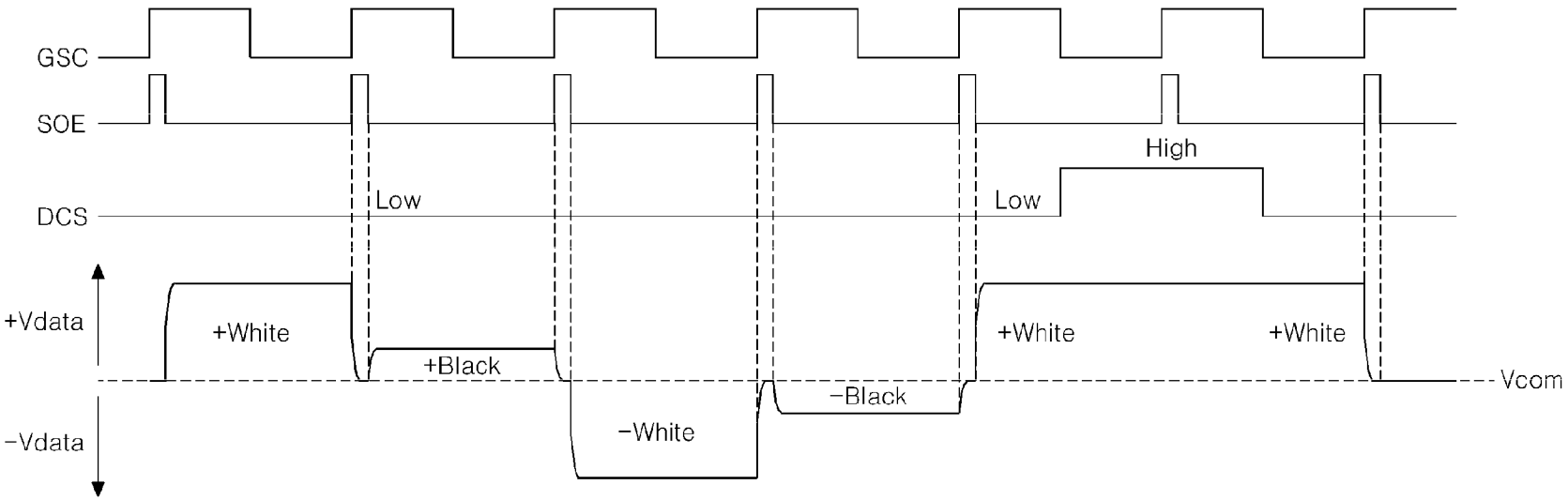
FIGS. 6A to 6C illustrate exemplary waveforms of dynamic charge sharing of the liquid crystal display according to an exemplary embodiment of the present invention.
Figure 6B:
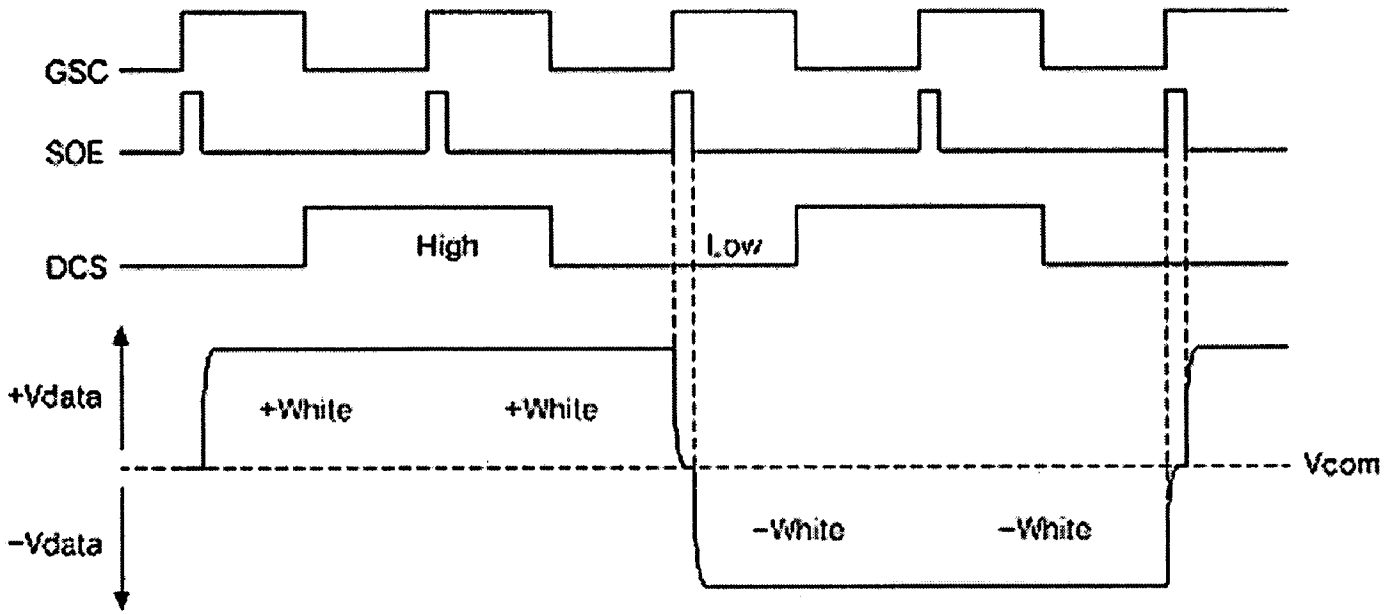
Figure 6C:
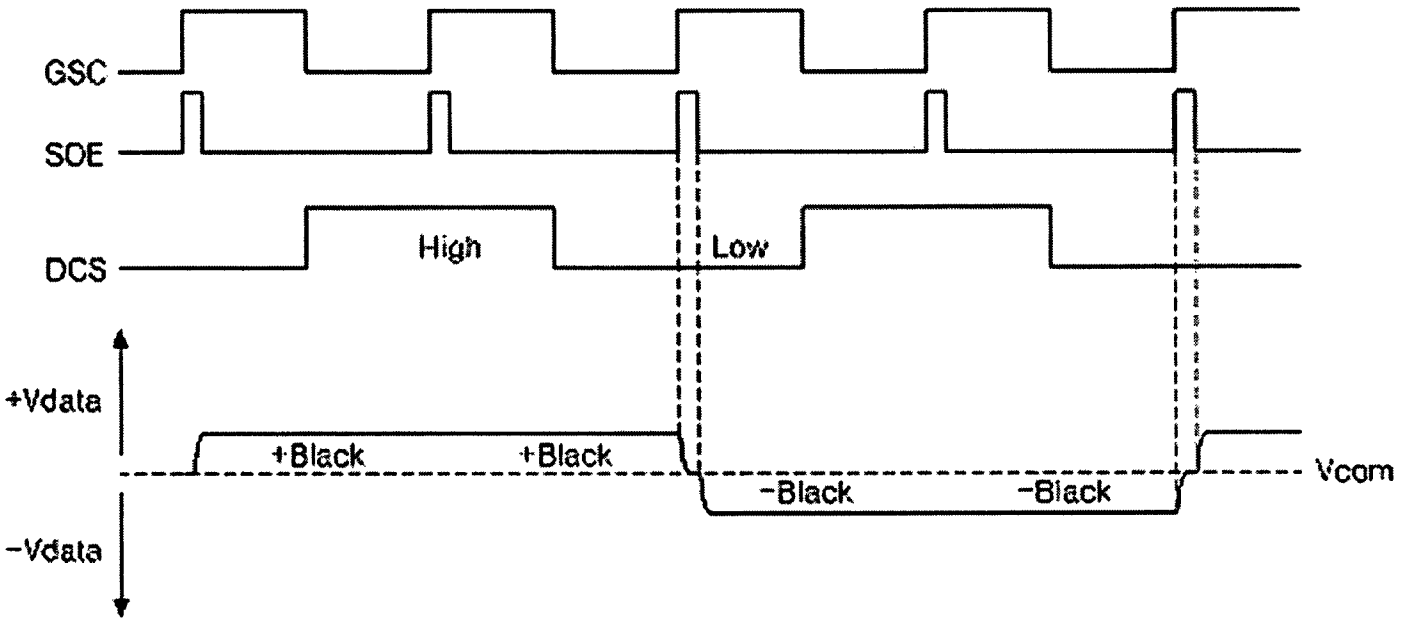

FIGS. 6A to 6C show exemplary waveforms illustrating examples of a DCS operation of the liquid crystal display according to an exemplary embodiment of the present invention. The data driving circuit 22 performs charge sharing during a non-scan period where gray levels of two data to be supplied to two liquid crystal cells vertically adjacent to each other, or representative gray levels of data to be supplied to two lines adjacent to each other, are changed from the white gray level W to the black gray level B, as shown in FIG. 6A. Further, the data driving circuit 22 performs charge sharing during a non-scan period where the polarity of two data voltages to be supplied to two liquid crystal cells that are vertically adjacent to each other is changed. However, the data driving circuit 22 prevents charge sharing when gray levels of two data to be supplied to two liquid crystal cells vertically adjacent to each other, or representative gray levels of data to be supplied to two lines adjacent to each other, are changed from the black gray level B to the white gray level W, from the black gray level B to the gray gray level G, or from the white gray level W to the white gray level W, as illustrated in FIG. 6B, or from the black gray level B to the black gray level B, as illustrated in FIG. 6C. Accordingly, the swing widths and the number of the rising edges of the data voltages supplied to the data lines D1 to Dm are reduced, thereby reducing the generation of heat and power consumption of the data driving circuit 22.

The data driving circuit 22 performs charge sharing when the DCS signal is a low logic and the source output enable signal SOE is a high logic, as shown in FIGS. 6A to 6C. On the other hand, the data driving circuit 22 does not perform charge sharing when the DCS signal is a high logic even if the source output enable signal SOE is a high logic, thereby supplying the data voltages to the data lines D1 to Dm. Further, the data driving circuit 22 supplies the data voltages to the data lines D1 to Dm irrespective of the logic level of the DCS signal when the source output enable signal SOE is a low logic.

Figure 7:
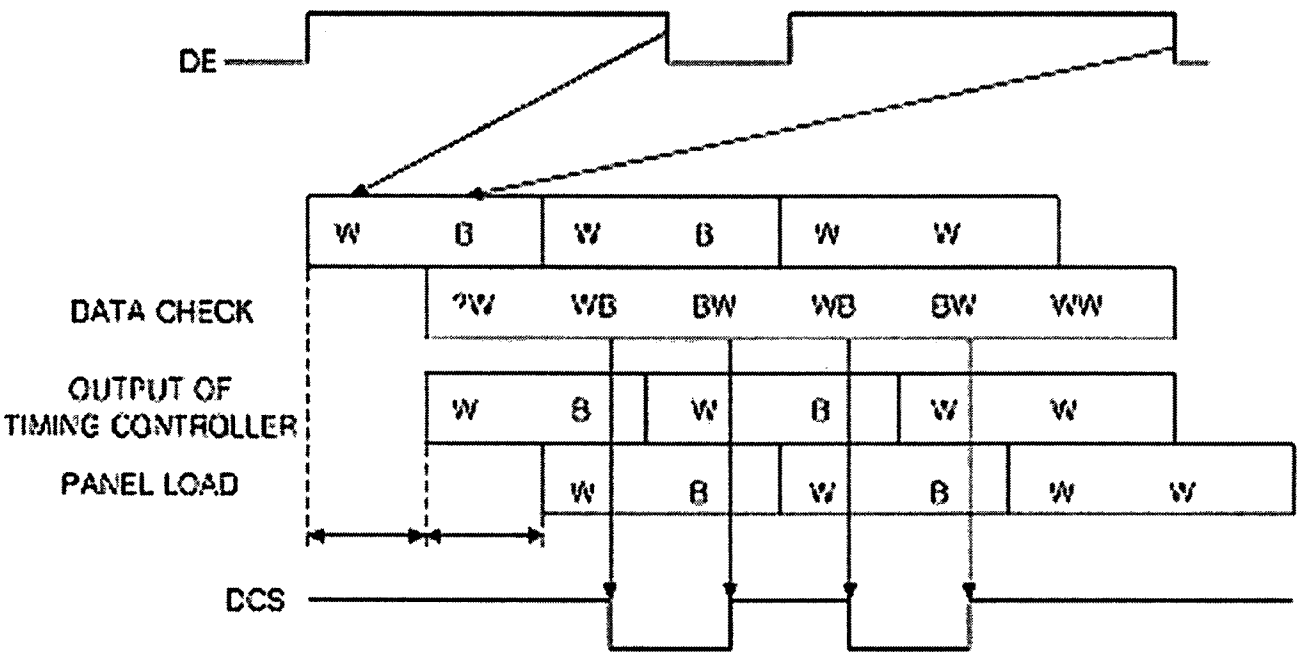
FIG. 7 illustrates an exemplary waveform of data check of the timing controller, and a data flow between the timing controller and the data driving circuit.

The driving method of the liquid crystal display according to an embodiment of the present invention checks the data of an input image at every line. The data check method in accordance with the present invention checks information about the gray levels of two line data during a period from the time when data are input to the timing controller 21 at every line to the time when data are supplied to the liquid crystal display panel 20 (hereinafter, referred to as "panel load time point"), as shown in FIG. 7. During the data analysis stage, information about the gray levels of the two line data is determined from the time of the data transmission of the timing controller 21 to the time of operation of the data driving circuit 22 and the panel load time point. Accordingly, additional memory need not be added to an existing timing controller and memory. In addition, information about the gray levels of data may be checked every line without changing the data flow of the timing controller 20 and the data driving circuit 22.

As above-mentioned, in accordance with the liquid crystal display and the driving method thereof according to the exemplary embodiment of the present invention, additional memory or change in the data flow is not required because of the dynamic charge sharing in accordance with the present invention. As a result, it is possible to achieve the effect of reducing the heat generation and power consumption of the data driving circuit as described above.

It will be apparent to those skilled in the art that various modifications and variations can be made in the liquid crystal display of the present invention and the driving method thereof without departing from the spirit or scope of the invention. Thus, it is intended that the present invention cover the modifications and variations of this invention provided they come within the scope of the appended claims and their equivalents.

What is claimed is:

1. A liquid crystal display, comprising:

a liquid crystal display panel including a plurality of data lines, a plurality of gate lines crossing the plurality of data lines, and a plurality of liquid crystal cells;

a timing controller comprising:

a data check unit configured to:

check gray levels of input digital video data to determine whether two digital video data that are input consecutively change from a white gray level to a black gray level; and generate a first charge share signal only when the digital video data are changed from the white gray level to the black gray level;

a polarity check unit configured to:

determine a time when a polarity of a data voltage to be supplied to the data lines is inverted by counting a gate shift clock; and generate a second charge share signal only when the polarity of the data voltage is inverted; and a dynamic charge share control signal generator configured to generate a dynamic charge share control signal only when the gray level of the data voltage is changed from a white gray level to a black gray level and the polarity of the data voltage is inverted, based on the first and second charge control signals;

a data driving circuit configured to:

convert the digital video data from the timing controller into the data voltage;

change the polarity of the data voltage; and supply any one of a common voltage and a charge share voltage to the data lines in response to the dynamic charge share control signal only when the digital video data are changed from the white gray level to the black gray level and the polarity of the data voltage is inverted; and a gate driving circuit configured to sequentially supply scan pulses to the gate lines under the control of the timing controller.

2. The liquid crystal display of claim 1, wherein:

the timing controller further generates gate timing signals including a gate start pulse, a gate shift clock signal, and a gate output enable signal to control an operation timing of the gate driving circuit, and data timing signals including a source start pulse, a source sampling clock, a source output enable signal, and a polarity control signal to control an operation timing of the data driving circuit, and the polarity control signal is inverted every N horizontal period so that the polarity of the data voltage supplied to the data lines is inverted according to vertical N-dot (wherein, N is an integer equal to or greater than 2) inversion method.

3. The liquid crystal display of claim 1, wherein the data check unit determines a gray level of each of digital video data included in one line based on the most significant bits of each of the digital video data included in the one line, compares a dominant gray level of the digital video data included in the one line with a specific threshold value, and determines the dominant gray level of digital video data as the gray level of the data voltage.

4. A method of driving a liquid crystal display including a liquid crystal display panel having a plurality of data lines, a plurality of gate lines crossing the plurality of data lines, a plurality of liquid crystal cells, a data driving circuit to convert digital video data into a data voltage to be supplied to the data lines and changing a polarity of the data voltage, and a gate driving circuit to sequentially supply scan pulses to the gate lines, the method comprising:

determining gray levels of input digital video data and a time when the polarity of the data voltage to be supplied to the data lines is inverted;

generating a dynamic charge share control signal only when the gray level of the data voltage to be supplied to the data lines is changed from a white gray level to a black gray level and the polarity of the data voltage is inverted; and supplying any one of a common voltage and a charge share voltage to the data lines by controlling the data driving circuit using the dynamic charge share control signal, wherein the step of generating the dynamic charge share control signal includes:

checking the gray level of the digital video data, determining whether two digital video data that are input consecutively are changed from the white gray level to the black gray level, and generating a first charge share signal only when the digital video data are changed from the white gray level to the black gray level;

determining a time when the polarity of the data voltage to be supplied to the data lines is inverted by counting a gate shift clock and generating a second charge share signal only when the polarity of the data voltage is inverted; and generating the dynamic charge share control signal only when the gray level of the data voltage is changed from a white gray level to a black gray level and the polarity of the data voltage is inverted based on the first charge share signal and the second charge share signal.

5. The method of claim 4, further comprising:

generating gate timing signals including a gate start pulse, a gate shift clock, and a gate output enable signal, to control an operation timing of the gate driving circuit; and generating data timing signals including a source start pulse, a source sampling clock, a source output enable signal, and a polarity control signal, to control an operation timing of the data driving circuit, wherein the polarity control signal is inverted every N horizontal period so that the polarity of the data voltage supplied to the data lines is inverted according to a vertical N-dot (wherein, N is an integer equal to or greater than 2) inversion method.

6. The method of claim 4, wherein the step of generating the first charge share signal includes determining a gray level of each of digital video data included in one line based on the most significant bits of each of the digital video data included in the one line, comparing a dominant gray level of the digital video data included in the one line with a specific threshold value, and determining the dominant gray level of digital video data as the gray level of the data voltage.

* * * * *